US010788282B2

(12) United States Patent
Baumann et al.

(10) Patent No.: US 10,788,282 B2
(45) Date of Patent: Sep. 29, 2020

(54) COMBAT VEHICLE HAVING A WEAPON SYSTEM

(71) Applicant: RHEINMETALL WAFFE MUNITION GMBH, Unterluess (DE)

(72) Inventors: Berthold Baumann, Unterluess (DE); Andreas Blache, Loerrach (DE); Stefan Radczinsky, Leipzig (DE); Heiner Schmees, Celle (DE); Florian Schwieger, Braunschweig (DE)

(73) Assignee: RHEINMETALL WAFFE MUNITION GMBH, Unterluess (DE)

( * ) Notice: Subject to any disclaimer, the term of this patent is extended or adjusted under 35 U.S.C. 154(b) by 0 days.

(21) Appl. No.: 16/219,090

(22) Filed: Dec. 13, 2018

(65) Prior Publication Data

US 2019/0120585 A1 Apr. 25, 2019

Related U.S. Application Data

(63) Continuation of application No. PCT/EP2017/062036, filed on May 18, 2017.

(30) Foreign Application Priority Data

Jun. 13, 2016 (DE) ..... 20 2016 103 110 U
Sep. 7, 2016 (DE) ..... 20 2016 104 939 U

(51) Int. Cl.
*F41A 21/12* (2006.01)
*F41A 11/02* (2006.01)
(Continued)

(52) U.S. Cl.
CPC ..... *F41A 21/12* (2013.01); *F41A 11/02* (2013.01); *F41A 21/16* (2013.01); *F41A 21/48* (2013.01);
(Continued)

(58) Field of Classification Search
CPC ..... F41A 21/12–16; F41A 11/02
See application file for complete search history.

(56) References Cited

U.S. PATENT DOCUMENTS 2,815,602 A 12/1957 Young
4,066,000 A * 1/1978 Rostocil ..... F41A 9/30 89/198
(Continued)

FOREIGN PATENT DOCUMENTS

DE 3836718 A1 * 5/1990 ..... F41A 27/08
DE 3836718 A1 5/1990
(Continued)

OTHER PUBLICATIONS

"Voluntary Industry Performance Standards for Pressure and Velocity of Centerfire Rifle Ammunition for the Use of Commercial Manufacturers", SAAMI Z299.4, Sporting Arms and Ammunition Manufacturers' Institute (SAAMI) (Year: 2015).*
(Continued)

*Primary Examiner* — Joshua T Semick
(74) *Attorney, Agent, or Firm* — Muncy, Geissler, Olds & Lowe, P.C.

(57) ABSTRACT

The installation space dimensions of a weapon system in the tower are complied with, and a loading space diameter of a caliber-larger weapon barrel is approximately maintained in relation to the smaller caliber. The required larger loading space volume for the caliber increase is predominantly achieved by an extension of the loading space of the caliber-larger weapon barrel relative to a loading space of the caliber-smaller weapon barrel itself. Since the loading space diameter of a larger caliber remains virtually unchanged, the outer dimensions of the caliber-larger weapon barrel also remain virtually unchanged compared to
(Continued)

the outer dimensions of the caliber-smaller weapon barrel in the region of the loading part.

4 Claims, 2 Drawing Sheets

(51) Int. Cl.

| | |
|---|---|
| ***F41A 21/16*** | (2006.01) |
| ***F41A 21/48*** | (2006.01) |
| ***F41A 23/24*** | (2006.01) |
| ***F41A 27/10*** | (2006.01) |
| *F41H 7/02* | (2006.01) |

(52) U.S. Cl.
CPC ..... *F41A 23/24* (2013.01); *F41A 27/10* (2013.01); *F41H 7/02* (2013.01)

(56) References Cited

U.S. PATENT DOCUMENTS

| | | | |
|---|---|---|---|
| 7,624,526 | B2 | 12/2009 | Paasikivi et al. |
| 2001/0045045 | A1 | 11/2001 | Katzmaier |

FOREIGN PATENT DOCUMENTS

| | | | | |
|---|---|---|---|---|
| FR | 2852091 | A1 * | 9/2004 | ..... F41A 21/12 |
| GB | 232989 | A | 10/1925 | |
| WO | WO2006/003265 | A1 | 1/2006 | |

OTHER PUBLICATIONS

International Search Report dated Jul. 21, 2017 in corresponding application PCT/EP2017/062036.
Written Opinion of the International Searching Authority dated Jul. 21, 2017 in corresponding application PCT/EP2017/062036/.
May 23, 2012 {May 23, 2012), XP055390991. Retrieved from the Internet: URl:https://web.archive.org/web/20120523173043/https://en.wikipedh.org/wiki/.17_HM2 [retrieved on Jul. 14, 2017] siehe "Specifications• und Ballistic performance & Anonymous:" .22 Winchester Magnum Rimfire—Wi kipedia, the free encyclopedia';. 11.
Nov. 29, 2012 (Nov. 29, 2012)~XP055391002. Retrieved from the Internet: URL: https ://web.archive. org/web/20121129083531/https://en.wikipedia.org/wiki/.22_Winchester Magnum Rimfire [retrieved on Jul. 14, 2017] siehe "Specifications" und Ballistic performance 11.
Jan. 1, 2008 (Jan. 1, 2008)~ XP55390903, Retrieved from the Internet: URL:https://web.archive.org/web/20080101103639/http://www.panzerbaer.de:80/guns/re1aunch/bwfh UJ5rrm-e.htm [retrieved-on Jul. 14, 2017] the whole document.

* cited by examiner

COMBAT VEHICLE HAVING A WEAPON SYSTEM

This nonprovisional application is a continuation of International Application No. PCT/EP2017/062036, which was filed on May 18, 2017, and which claims priority to German Patent Application No. 20 2016 103 110.9, which was filed in Germany on Jun. 13 2016, and to German Patent Application No 20 2016 104 939.3, which was filed in Germany on Sep. 7, 2016 and which are all herein incorporated by reference.

BACKGROUND OF THE INVENTION

Field of the Invention

The present invention relates to a weapon system, in particular having an increased caliber with an unchanged interface in an existing turret of a combat vehicle such as the Leopard 2 or Leclerc, for example. The invention relates, in particular, to the fitting of a weapon system with a larger caliber diameter in the existing "turret" interface of a smaller-caliber weapon system with the aim of increasing the performance of the weapon system and therefore of the combat vehicle.

Description of the Background Art

Geopolitical locational changes and past deployment experience have made it clear that powerful, highly maneuverable, well-trained and well-equipped combat forces are an indispensable resource in security policy. The notion of improving combat effectiveness involves making multiple improvements to existing systems, devices, vehicles, etc., so that they are able to fulfil the new requirements.

The Leopard 2 battle tank currently has a weapon system with a 120 mm caliber. In the late 70's this replaced the Leopard 1 battle tank with a 105 mm caliber gun that had been used hitherto. An increased caliber was introduced. However, a caliber increase in a battle tank has substantial implications for the battle tank system as a whole. These implications are reflected in, among other things, the installation space and the dimensions of the weapon system due to a larger loading space. Turret loading or system loading has proved problematic. Problems also result from ammunition handling (dimensions) and also the dimensions of the ammunition bunker. Earlier studies on the fitting of a new weapon system, for example a 140 mm caliber system, have highlighted the aforementioned problems.

SUMMARY OF THE INVENTION

It is therefore an object of the invention to substantial increase the performance in a weapon system of a battle tank while solving the aforementioned problems.

In an exemplary embodiment, the invention is based on the assumption that a significant performance increase (firepower) of the Leopard 2 battle tank is possible predominantly through the use of a larger caliber diameter and a greater loading space volume of the weapon system.

DE 38 36 718 C2, which is incorporated herein by reference, discloses the use of smooth-barrel technology in battle tanks, and discloses a trunnion bearing which can receive cradles with different installation heights for different caliber barrels and thereby guarantees different barrel firing heights in each case.

GB 232,989, which is incorporated herein by reference, discloses a facility enabling ammunition to be fired from a drawn barrel over a very long or a very short range. The cartridge chamber of the barrel has at least two pressure cones, as a result of which projectiles of different lengths can be fired from the barrel. A barrel for firing ammunition with different cartridge lengths is described in U.S. Pat. No. 2,815,602, which is incorporated herein by reference.

However the invention is based on the idea of observing the installation space dimensions of the original weapon system with a new weapon system and more or less maintaining the loading space diameter of the larger-caliber barrel in relation to the smaller-caliber barrel. The greater loading space volume required for the caliber increase is achieved according to the invention predominantly through a lengthening of the loading space of the barrel itself. Since the loading space diameter remains virtually unchanged with a larger caliber, the outer dimensions of the barrel also remain virtually unchanged in the region of the loading part.

The increase in the loading space length should be selected depending on the desired firing performance. This increase in length is determined by the desired firing range (required length of the penetrator of the KE ammunition) and the necessary mass of the propelling charge resulting from this. The ammunition length is restricted by the maximum size of the ammunition bunker in the combat vehicle.

The above considerations and specifications therefore have no or only a slight influence on the outer dimensions of the weapon system itself. The greater blowback can be offset by a lengthening of the recoil path of the weapon system. A further performance increase would be possible with an increase in the gas pressure level via a higher-strength material for the barrel and breech.

The advantage of this idea is that dimension-related problems are averted with the new larger-caliber weapon system. There is a substantial performance increase in the weapon system due to a greater caliber diameter and a greater loading space. The performance improvement is substantially achieved through the increase in the caliber diameter, the lengthening of the loading space and the greater propelling charge volume thereby achieved, and also a lengthening of the projectiles (e.g. KE penetrators) which is thereby made possible. In other words, more propelling charge powder and longer projectiles (such as KE penetrators) can be used. This increases the on-target effectiveness (performance).

It is proposed that the installation space dimensions of a weapon system in the turret should be observed and a loading space diameter of a larger-caliber barrel more or less maintained in relation to the smaller-caliber barrel. The greater loading space volume required for the increased caliber is predominantly achieved according to the invention though a lengthening of the loading space of the larger-caliber barrel compared with a loading space of the smaller-caliber barrel. Since the loading space diameter with a larger caliber remains virtually unchanged, the outer dimensions of the larger-caliber barrel compared with the outer dimensions of the smaller-caliber barrel also remain virtually unchanged in the region of the loading part. The increased caliber weapon system with barrel, breech and blowback system can be integrated in the existing interface of a smaller weapon system in the turret of the battle tank. The smaller-caliber weapon system can be exchanged for and/or replaced by a larger-caliber weapon system while maintaining the existing interface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
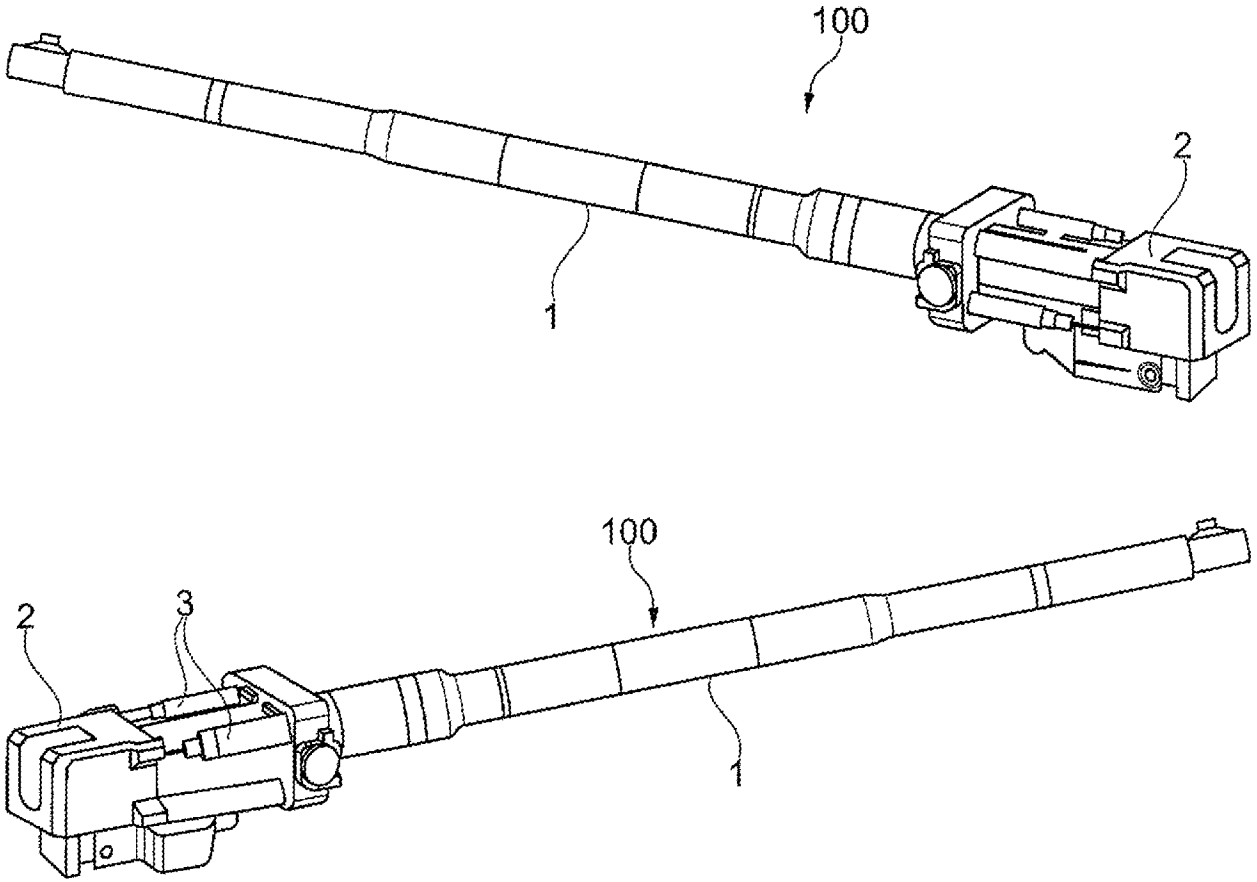
FIG. 1 shows a perspective representation of a weapon system.

FIG. 1 shows a weapon system 100 with a barrel 1, breech 2 and blowback system 3, these being the principle subassemblies of the weapon system 100.

Figure 2:
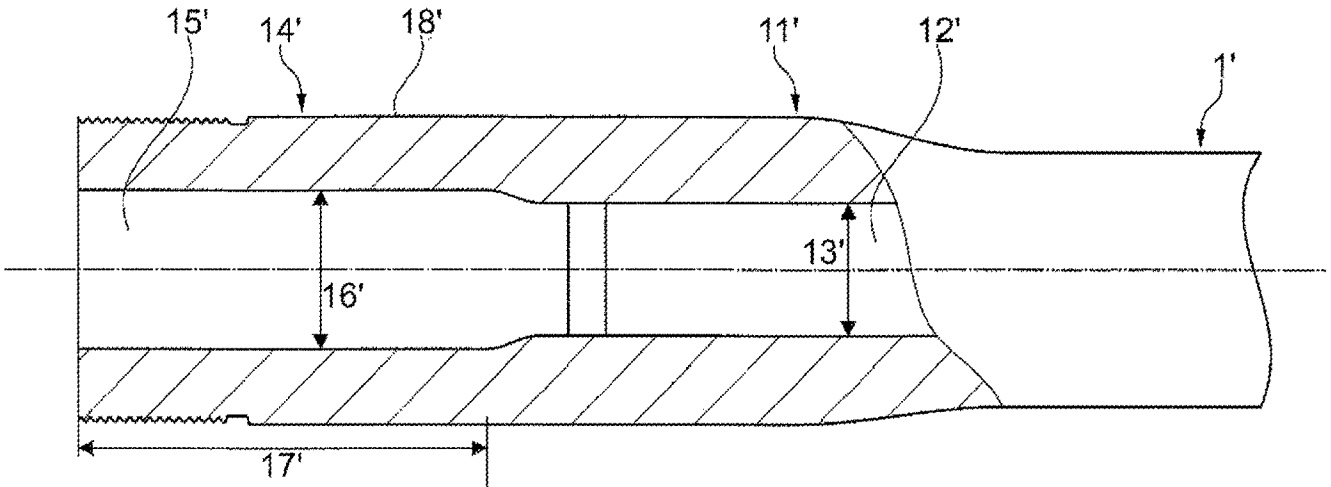
FIG. 2 shows a schematic representation of a section through a barrel with a smaller caliber according to the prior art.

In FIG. 2 a barrel 1' according to the prior art is depicted schematically in section. A front region 11' of the barrel 1' is a caliber part 12' with a caliber diameter 13'. A rear region 14' of the barrel 1' is a loading space 15' with a loading space diameter 16' and a loading space length 17'.

Figure 3:
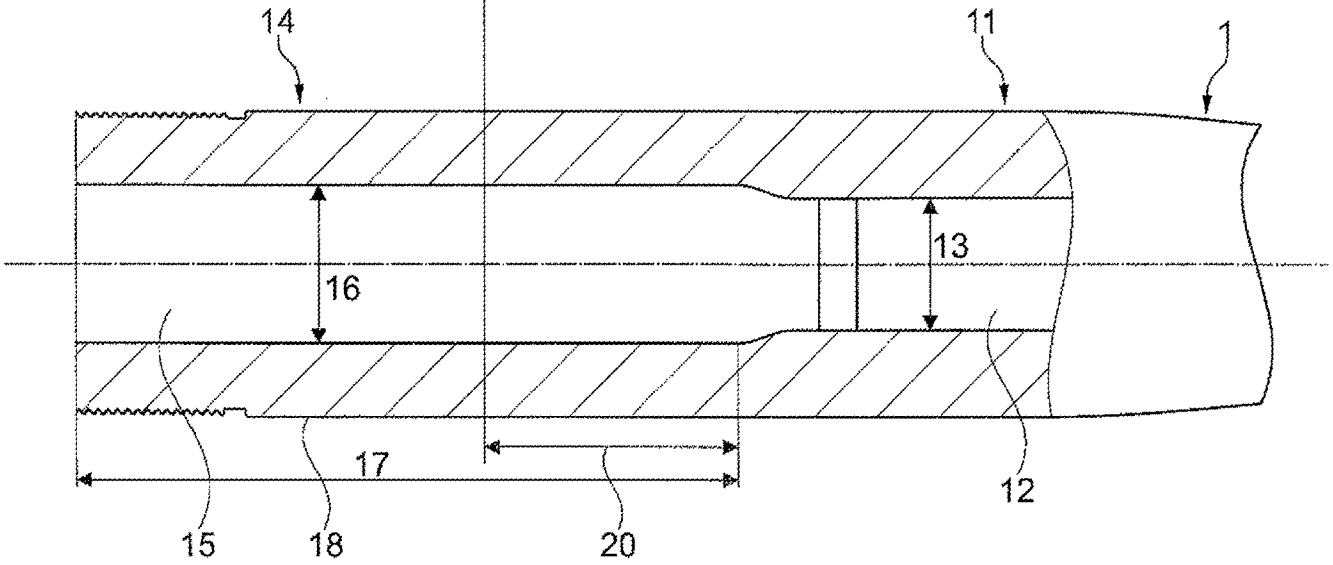
FIG. 3 shows a schematic representation of a section through a barrel with a larger caliber.

FIG. 3 shows a sectional view of the barrel 1 according to the invention compared with the prior art as a schematic depiction. A front region 11 is a caliber part 12 with a caliber diameter 13. A rear region 14 is a loading space 15 with a loading diameter 16 and a loading space length 17.

The barrel 1' in FIG. 2 has a smaller caliber than the barrel 1 in FIG. 3. The barrel 1' in the present embodiment has a 120 mm caliber; the barrel 1 has a 130 mm caliber. The caliber diameter 13' (120 mm) of the smaller-caliber barrel 1' is therefore smaller than the caliber diameter 13 (130 mm) of the larger-caliber barrel 1.

The weapon system 100 is integrated via an interface of a battle tank etc., usually in a turret (Lafette) and fitted therein. Each weapon system in this case requires a so-called installation space in the turret.

So that existing interfaces with/in the turret and the existing installation space (not shown in greater detail) for the weapon system 100' with a barrel 1' can be used by a weapon system 100 with the larger-caliber barrel 1, the loading space diameter 16 of the barrel 1 is maintained in relation to the loading space diameter 16' of the smaller-caliber barrel 1'.

However, the loading space length 17 of the loading space 15 of the larger-caliber barrel 1 is changed relative to the loading space length 17' of the loading space 15' of the smaller-caliber barrel 1' (see FIG. 3) by a lengthening 20. The outer dimensions 18, 18' of the barrels 1, 1' are the same, however, in the region of the loading space 15, 15', i.e. the outer dimension 18 of the larger-caliber barrel 1 remains virtually unchanged compared with the smaller-caliber barrel 1', so virtually unchanged in this region.

The lengthening 20 of the loading space 17 in this case depends on the length of the ammunition used or to be fired and also the amount of propelling charge required to improve on-target performance.

In order to observe the permitted loading capacity of the turret or the interface, the recoil path of the weapon system 100 may be lengthened, for example.

The idea behind the invention to increase the performance of a weapon system, as described, is not limited to the 130 mm caliber and can also be used in small-, medium- and other large-caliber weapon systems.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon system comprising:

a blowback system, comprising a breech block; and a replaceable barrel with a loading space, wherein the replaceable barrel has a loading space lengthening compared with a loading space of a smaller-caliber barrel while maintaining a loading space diameter of the smaller-caliber barrel, wherein the replaceable barrel has a caliber part with a larger caliber diameter than that of the smaller-caliber barrel, and wherein the caliber part of the replacement barrel is a 130 mm caliber part and the caliber part of the smaller-caliber barrel is a 120 mm caliber part.

2. A combat vehicle comprising a weapon system as claimed in claim 1.

3. The combat vehicle as claimed in claim 2, wherein the combat vehicle is a battle tank.

4. A weapon system, comprising:

a replaceable barrel configured to accommodate a caliber part, comprising:

a chamber; and a bore, wherein a length of the chamber is longer than a length of a chamber for a barrel accommodating a caliber part smaller than the caliber part of the replaceable barrel, wherein a diameter of the bore is larger than a diameter of a bore for the barrel accommodating the caliber part smaller than the caliber part of the replaceable barrel, wherein a diameter of the chamber is the same as a diameter of the chamber for the barrel accommodating the caliber part smaller than the caliber part of the replaceable barrel, and wherein the caliber part of the replacement barrel is a 130 mm caliber part and the caliber part of the barrel accommodating the caliber part smaller than the caliber part of the replaceable barrel is a 120 mm caliber part.

* * * * *